US005208421A

United States Patent [19]

Lisle et al.

[11] Patent Number: 5,208,421

[45] Date of Patent: May 4, 1993

[54] METHOD AND APPARATUS FOR AUDIO EDITING OF MIDI FILES

[75] Inventors: Ronald J. Lisle, Cedar Park; Daniel J. Moore, Austin; Steven C. Penn, Georgetown; Michael D. Wilkes, Austin, all of Tex.

[73] Assignee: International Business Machines Corporation, Armonk, N.Y.

[21] Appl. No.: 608,113

[22] Filed: Nov. 1, 1990

[51] Int. Cl.[5] ..... G10H 7/00

[52] U.S. Cl. ..... 84/645

[58] Field of Search ..... 84/609-614, 84/634-638, 645

[56] References Cited

U.S. PATENT DOCUMENTS 4,960,031 10/1990 Farrand ..... 84/609

*Primary Examiner*—Stanley J. Witkowski

*Attorney, Agent, or Firm*—Andrew J. Dillon

[57] ABSTRACT

A method and apparatus are disclosed for the audio editing of MIDI (Musical Instrument Digital Interface) files. MIDI files make it possible to exchange information such as: musical notes, program changes, expression control and channel information between musical instruments, sequencers, computers, lighting controllers and mixers. MIDI files generally consist of serially listed channel and system messages which include at least program status messages and matching note on and note off messages. The method and apparatus of the present invention may be utilized to ensure the integrity of a source file, a copied or lifted section or a target file by automatically inserting matching note on or note off messages into a file or file section to correct inconsistencies created by such editing. Additionally, program status messages are automatically inserted into source files, copied or lifted sections, or target files to yield results which are consistent with the results which may be obtained by editing digital audio data. Timing information is selectively added or maintained such that MIDI files may be selectively edited without requiring a user to learn a complex MIDI sequencer.

12 Claims, 4 Drawing Sheets

| TIME (SEC.) 46 | EVENT 48 |
|---|---|
| ____ | ACPAVA C1 = Piano |
| ____ | ACPAVA C2 = String Bass |
| 0.000 | Channel 1, Note 1 ON |
| 0.001 | Channel 1, Note 2 ON |
| 0.002 | Channel 2, Note 1 ON |
| 0.003 | Channel 1, Note 5 ON |
| 3.000 | Channel 1, Note 3 ON |
| 3.001 | Channel 1, Note 4 ON |
| 4.000 | ACPAVA C2 = Flute |
| 4.000 | Channel 1, Note 5 OFF |
| 6.000 | Channel 1, Note 3 OFF |
| 7.000 | Channel 1, Note 1 OFF |
| 8.000 | Channel 1, Note 2 OFF |
| 9.000 | Channel 1, Note 4 OFF |
| 9.100 | Channel 2, Note 6 ON |
| 11.00 | Channel 3, Note 1 OFF |

Fig. 4

| TIME (SEC.) 54 | EVENT 56 |
|---|---|
| ____ | ACPAVA C1 = Piano |
| ____ | ACPAVA C2 = String Bass |
| 0.000 | Channel 1, Note 1 ON |
| 0.001 | Channel 1, Note 2 ON |
| 0.002 | Channel 2, Note 1 ON |
| 0.003 | Channel 1, Note 5 ON |
| 3.000 | ACPAVA C2 = Flute |
| 3.000 | Channel 1, Note 5 OFF |
| 3.001 | Channel 1, Note 1 OFF |
| 4.000 | Channel 1, Note 2 OFF |
| 5.000 | Channel 1, Note 4 OFF |
| 5.100 | Channel 2, Note 6 ON |
| 7.000 | Channel 3, Note 1 OFF |

52 58 60

Fig. 5

| TIME (SEC.) 64 | EVENT 66 |
|---|---|
| ____ | ACPAVA C1 = Piano |
| ____ | ACPAVA C2 = String Bass |
| 0.000 | Channel 1, Note 1 ON |
| 0.001 | Channel 1, Note 2 ON |
| 0.002 | Channel 2, Note 1 ON |
| 0.003 | Channel 1, Note 5 ON |
| 3.000 | ACPAVA C2 = Flute |
| 3.000 | Channel 1, Note 5 OFF |
| 3.001 | Channel 1, Note 1 OFF |
| 4.000 | Channel 1, Note 2 OFF |
| 5.000 | Channel 1, Note 4 OFF |
| 5.100 | Channel 2, Note 6 ON |
| 7.000 | Channel 3, Note 1 OFF |
| 8.000 | ACPAVA C1 = Piano |
| 8.000 | ACPAVA C2 = String Bass |
| 8.000 | Channel 2, Note 6 OFF |
| 8.000 | Channel 1, Note 5 ON |
| 8.000 | Channel 1, Note 3 ON |
| 8.001 | Channel 1, Note 4 ON |
| 9.000 | ACPAVA C2 = Flute |
| 9.000 | Channel 1, Note 5 OFF |
| 11.000 | Channel 1, Note 3 OFF |
| 11.999 | Channel 1, Note 4 OFF |
| 12.000 | ACPAVA C1 = Piano |
| 12.000 | ACPAVA C2 = Flute |

62 70 72 68 74

METHOD AND APPARATUS FOR AUDIO EDITING OF MIDI FILES

BACKGROUND OF THE INVENTION

1. Technical Field

The present invention relates in general to the field of musical synthesis and in particular to the field of digital musical synthesizers which utilize Musical Instrument Digital Interface (MIDI) files. Still more particularly, the present invention relates to a method and apparatus for permitting the efficient editing of MIDI files utilizing traditional "cut and paste" techniques.

2. Description of the Related Art

MIDI, the "Musical Instrument Digital Interface" was established as a hardware and software specification which would make it possible to exchange information such as: musical notes, program changes, expression control, etc. between different musical instruments or other devices such as: sequencers, computers, lighting controllers, mixers, etc. This ability to transmit and receive data was originally conceived for live performances, although subsequent developments have had enormous impact in recording studios, audio and video production, and composition environments.

A standard for the MIDI interface has been prepared and published as a joint effort between the MIDI Manufacturer's Association (MMA) and the Japan MIDI Standards Committee (JMSC). This standard is subject to change by agreement between JMSC and MMA and is currently published as the MIDI 1.0 Detailed Specification, Document Version 4.1, January 1989.

The hardware portion of the MIDI interface operates at 31.25 KBaud, asynchronous, with a start bit, eight data bits and a stop bit. This makes a total of ten bits for a period of 320 microseconds per serial byte. The start bit is a logical zero and the stop bit is a logical one. Bytes are transmitted by sending the least significant bit first. Data bits are transmitted in the MIDI interface by utilizing a five milliamp current loop. A logical zero is represented by the current being turned on and a logical one is represented by the current being turned off. Rise times and fall times for this current loop shall be less than two microseconds. A five pin DIN connector is utilized to provide a connection for this current loop with only two pins being utilized to transmit the current loop signal. Typically, an opto-isolater is utilized to provide isolation between devices which are coupled together utilizing a MIDI format.

Communication utilizing the MIDI interface is achieved through multi-byte "messages" which consist of one status byte followed by one or two data bytes. There are certain exceptions to this rule. MIDI messages are sent over any of sixteen channels which may be utilized for a variety of performance information. There are five major types of MIDI messages: Channel Voice; Channel Mode; System Common; System Real-Time; and, System Exclusive. A MIDI event is transmitted as a message and consists of one or more bytes.

A channel message in the MIDI system utilizes four bits in the status byte to address the message to one of sixteen MIDI channels and four bits to define the message. Channel messages are thereby intended for the receivers in a system whose channel number matches the channel number encoded in the status byte. An instrument may receive a MIDI message on more than one channel. The channel in which it receives its main instructions, such as which program number to be on and what mode to be in, is often referred to as its "Basic Channel." There are two basic types of channel messages, a Voice message and a Mode message. A Voice message is utilized to control an instrument's voices and Voice messages are typically sent over voice channels. A Mode message is utilized to define the instrument's response to Voice messages, Mode messages are generally sent over the instrument's Basic Channel.

System messages within the MIDI system may include Common messages, Real-Time messages, and Exclusive messages. Common messages are intended for all receivers in a system regardless of the channel that receiver is associated with. Real-Time messages are utilized for synchronization and are intended for all clock based units in a system. Real-Time messages contain status bytes only, and do not include data bytes. Real-Time messages may be sent at any time, even between bytes of a message which has a different status. Exclusive messages may contain any number of data bytes and can be terminated either by an end of exclusive or any other status byte, with the exception of Real-Time messages. An end of exclusive should always be sent at the end of a system exclusive message. System exclusive messages always include a manufacturer's identification code. If a receiver does not recognize the identification code it will ignore the following data.

As those skilled in the art will appreciate upon reference to the foregoing, musical compositions may be encoded utilizing the MIDI standard and stored and/or transmitted utilizing substantially less data. The MIDI standard permits the transmittal of a serial listing of program status messages and channel messages, such as "note on" and "note off" and as a consequence require substantially less digital data to encode than the straightforward digitization of an analog music signal.

A problem which has arisen as a result of the serial nature of the MIDI standard occurs when a user desires to edit a MIDI file by removing sections from one area of the file for utilization in a second or subsequent file or by deleting and/or altering sections of an existing file. Due to the serial nature of a MIDI file, the removal of a section of that file in a traditional "cut and paste" type operation may cause serious problems due to the removal of information which is necessary for the source file to continue to function. For example, a particular note may be turned on at one point within the serial data stream and be turned off at a second point in the data stream. The removal of that section of the data stream which includes the note off message will result in a "hanging" note which will never be turned off. Similarly, certain control functions such as: volume, balance, pan, sostenuto, soft pedal, tremolo, or other such functions may be unwittingly removed from the source file, resulting in an entirely unexpected and unacceptable modification to the source file, a lifted or copied section, or a target file which receives the lifted or copied section.

As a consequence, the editing of MIDI files is generally accomplished in the prior art by sophisticated users who utilize complex MIDI sequencers. It should therefore be apparent that a need exist for a method and apparatus which permits the rapid, efficient and uncomplicated editing of MIDI files, while retaining a result which is substantially identical to that which would occur in the editing of a digitized audio file.

SUMMARY OF THE INVENTION

It is therefore one object of the present invention to provide an improvement to the field of musical synthesis.

It is another object of the present invention to provide an improved method and apparatus for the editing of MIDI files in the field of digital musical synthesizers.

It is yet another object of the present invention to provide an improved method and apparatus for the editing of MIDI files in the field of digital musical synthesizers which permits the utilization of traditional "cut and paste" techniques.

The foregoing objects are achieved as is now described. The method and apparatus of the present invention permit the editing of MIDI files which are utilized to exchange information such as: musical notes, program changes, expression control and channel information between musical instruments, sequencers, computers, lighting controllers and mixers. MIDI files generally consist of serially listed channel and system messages which include at least program status messages and matching note on and note off messages. The method and apparatus of the present invention may be utilized to ensure the integrity of a source file, a copied or lifted section or a target file by automatically inserting matching note on or note off message into a file or file section to correct inconsistencies created by such editing. Additionally, program status messages, such as program change, control change or pitch blend are automatically inserted into source files, copied or lifted sections, or target files to yield results which are consistent with the results which may be obtained by editing digital audio data. Timing information is selectively added or maintained such that MIDI files may be selectively edited without requiring a user to learn a complex MIDI sequencer.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 4 is a textual representation of the MIDI file of FIG. 3 after a selected section has been removed utilizing the method and apparatus of the present invention;

FIG. 5 is a textual representation of the MIDI file of FIG. 4 after reinsertion of the selected section utilizing the method and apparatus of the present invention.

DETAILED DESCRIPTION OF PREFERRED EMBODIMENT

Figure 1:
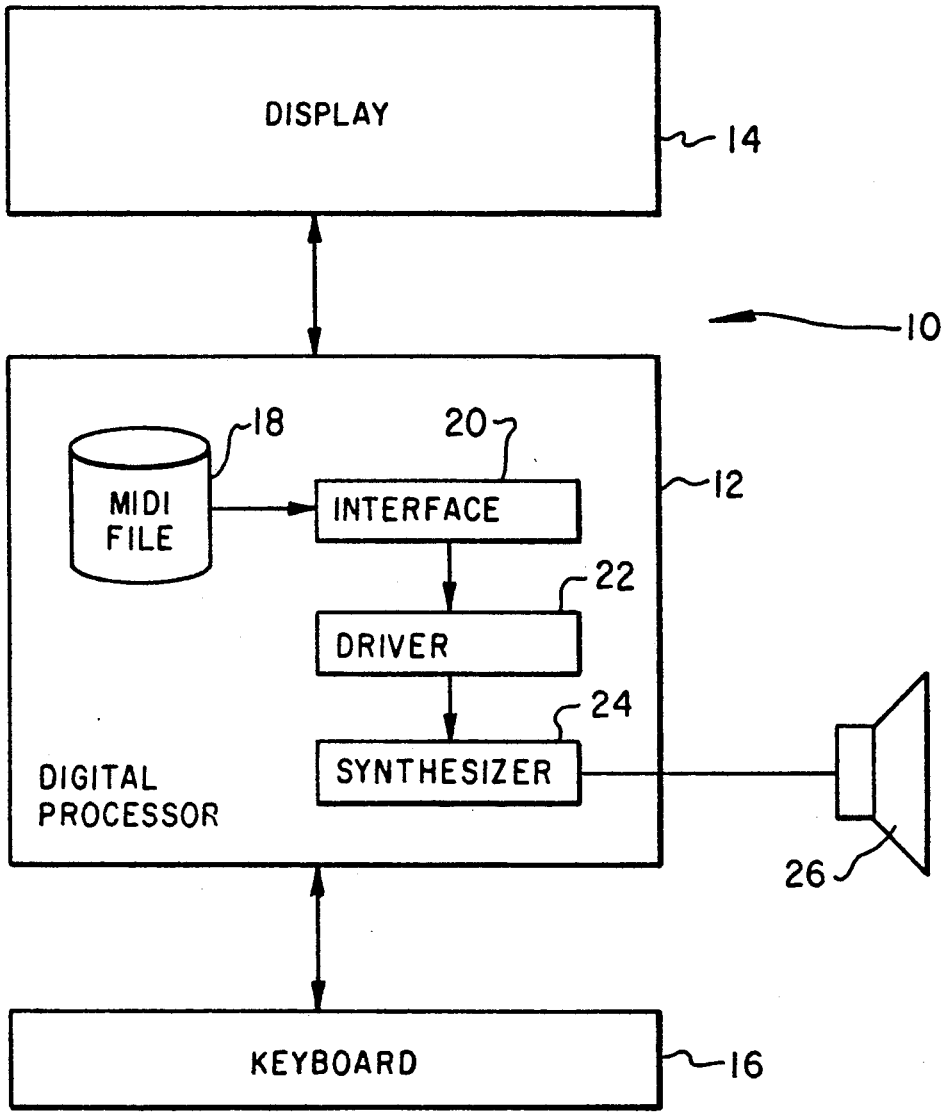
FIG. 1 is a block diagram depicting a computer system which may be utilized to edit MIDI files in accordance with the method and apparatus of the present invention.

With reference now to the figures and in particular with reference to FIG. 1, there is depicted a block diagram which illustrates a computer system which may be utilized to edit MIDI files in accordance with the method and apparatus of the present invention. As is illustrated, a computer system 10 is depicted. Computer system 10 may be implemented utilizing any state-of-the-art digital computer system having a suitable digital signal processor disposed therein which is capable of implementing a MIDI synthesizer. For example, computer system 10 may be implemented utilizing an IBM PS/2 type computer which includes an IBM Audio Capture and Playback Adapter (ACPA).

Also included within computer system 10 is a display 14. Display 14 may be utilized, as will be illustrated in greater detail herein, to display the audio editor capabilities of the method and apparatus of the present invention. Also coupled to computer system 10 is a computer keyboard 16 which may be utilized to designate sections of MIDI files for editing in accordance with the method and apparatus of the present invention. Of course, those skilled in the art will appreciate that a graphical pointing device, such as a mouse or light pen, may also be utilized to designate sections of a MIDI file for editing in accordance with the method and apparatus of the presently invention.

Referring now to digital processor 12, the implementation of a MIDI synthesizer utilizing a digital signal processor within a computer system is illustrated. As depicted, data contained within a MIDI file 18 is coupled to an interface 20. Interface 20 is preferably implemented utilizing any suitable audio application programming interface which permits the accessing of MIDI protocol files and the coupling of those files to an appropriate device driver. Device driver 22 is also preferably implemented in software and serves to process the MIDI file data in a manner which permits that data to be utilized to create synthesized music. Thereafter, the output of driver 22 is coupled to synthesizer 24. Synthesizer 24 is preferably a subtractive synthesizer which is implemented utilizing a suitable digital signal processor, such as the digital signal processor which is contained within the IBM Audio Capture and Playback Adapter (ACPA). Thereafter, the output of synthesizer 24 may be coupled to an audio output device, such as speaker 26.

Thus, in the manner illustrated in FIG. 1, a modern digital computer may be utilized to emulate a MIDI synthesizer by utilizing a special purpose digital signal processor to access MIDI files stored within memory within the computer and to create or recreate musical compositions which have been stored as digital MIDI files.

Figures 2, 3:
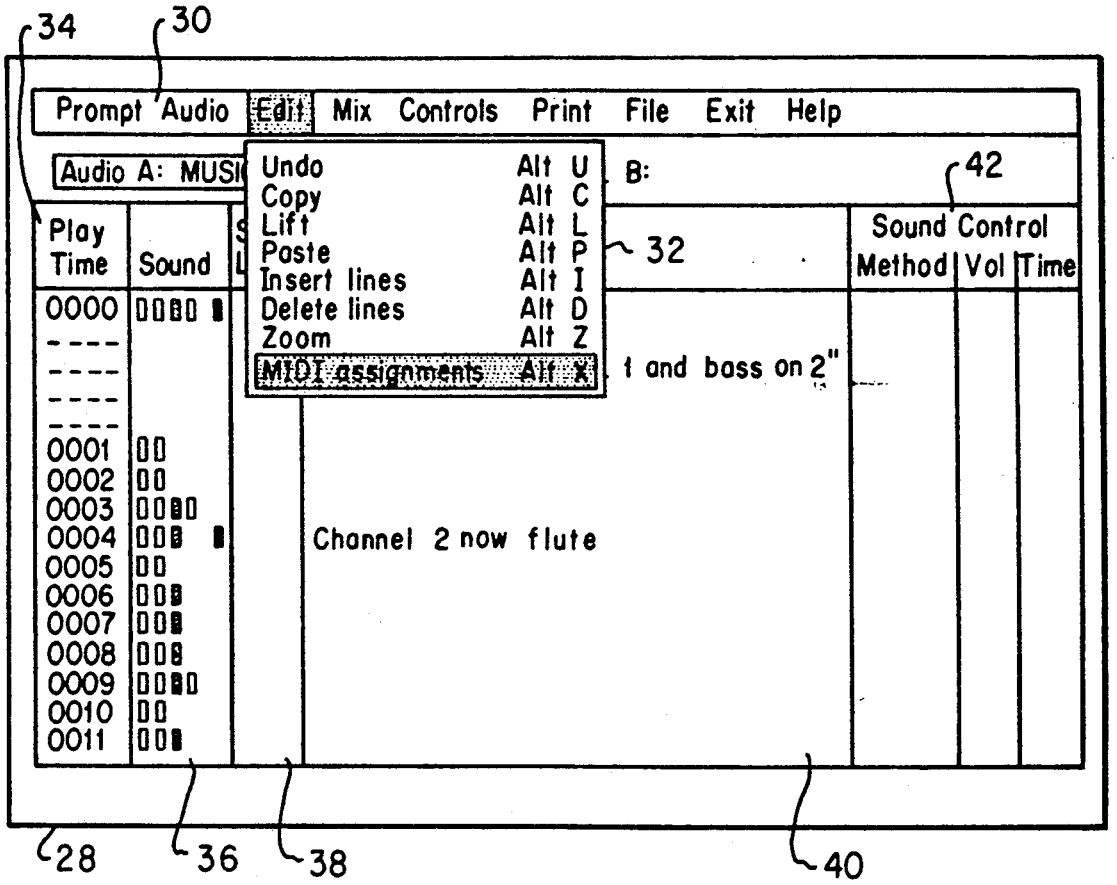
FIG. 2 is a pictorial representation of a computer display depicting an audio editor function in accordance with the method and apparatus of the present invention.
FIG. 3 is a textual representation of a MIDI file which may be edited utilizing the method and apparatus of the present invention.

Referring now to FIG. 2, there is depicted a pictorial representation of a computer display which illustrates an audio editor function which has been created in accordance with the method and apparatus of the present invention. As is illustrated, a computer display screen 28 is provided which may be utilized to display an audio editor function which may be utilized to implement the present invention. A command bar 30 is illustrated within display screen 28 and serves to depict, in a manner well known in the art, selected multiple command functions which may be selected by a computer user in any manner well known in the art. By selecting the "Edit" function from command bar 30, computer system 10 will cause display 14 to depict an edit command menu 32. As depicted, edit command menu 32 includes multiple traditional graphical editing type commands such as: "Undo";"Copy"; "Lift"; and, "Paste."

Also depicted within the audio editor function illustrated within Computer display screen 28 is play time column 34. Play time column 34 is utilized to illustrate an indication of play time associated with each message or status change within a MIDI file so that the appropriate tempo and timing for the represented musical composition may be maintained.

Sound column 36 is also illustrated within the audio editor function. As those skilled within this art will appreciate, the audio editor associated with the Audio Capture and Playback Adapter (ACPA) includes a sound column 36 which provides a graphic indication of the status of a MIDI data stream. The presence of one or more boxes within sound column 36 may be utilized to indicate various events within a MIDI data stream graphically.

Column 38 is the sync label column and column 40 is a comment column which permits the user of this system to enter textual comments for later use. Finally, sound control column 42 may be utilized to graphically illustrate various aspects of sound control which may be implemented utilizing the Audio Capture and Playback Adapter (ACPA) system discussed above.

With reference now to FIG. 3, there is depicted a textual representation of a MIDI file which may be edited utilizing the method and apparatus of the present invention. As is illustrated, MIDI file 44 includes a time column 46 and an event column 48. Listed below time column 46 are the relative times of each event within MIDI file 44. Beneath event column 48 are listed the serial program status messages and matching note on and note off messages which are typically found within a MIDI file.

Thus, an examination of MIDI file 44 leads those skilled in the art to understand that an initial voice assignment for channel 1 of piano and an initial voice assignment for channel 2 of string bass are listed. Next, a series of channel note on and note off messages are included. As illustrated, at relative time 4.000 a voice change for channel 2 occurs, changing the voice assignment for that channel to a flute voice.

At this point, illustrating an important feature of the present invention, that section of MIDI file 44 indicated within the bracket at reference numeral 50 will be "Lifted" or "Deleted" from MIDI file 44. Those skilled in the art will appreciate that while the graphic editing of word processing files or the like may be simply and easily accomplished utilizing traditional "cut and paste" methods, the editing of MIDI files is substantially more difficult. For example, the removal of the designated section of MIDI file 44 indicated within bracket 50 will delete the aforementioned voice assignment change which occurs at relative time 4.000 such that the section of MIDI file 44 which follows the deletion of that section within bracket 50 will continue to play utilizing a string base voice assignment for channel 2.

Thus, the removal of this designated section of MIDI file 44 will have an adverse and unintended effect on the remaining portion of MIDI file 44. Further, it should be noted that at relative time 4.000 a "note 5 off" message is included for channel 1. By the removal of the designated section of MIDI file 44 indicated within bracket 50 those skilled in the art will appreciate that note 5 within channel 1, which was turned on prior to the deletion of the designated section of MIDI file 44, will be left "hanging" without a matching note off message.

In view of the above, those skilled in the art will appreciate that the editing of MIDI files is a complex matter which may not be simply and efficiently accomplished utilizing state-of-the-art techniques.

Referring now to FIG. 4, there is depicted a textual representation of the MIDI file of FIG. 3 after the designated section has been removed utilizing the method and apparatus of the present invention. As above, MIDI file 52 illustrated within FIG. 4 includes a time column 54 and an event column 56. In accordance within an important feature of the present invention, the removal of the designated section of MIDI file 44 indicated at reference numeral 50 (see FIG. 3) is compensated for within MIDI file 52 by the automatic insertion of a copy of any voice assignment message within that designated section into MIDI file 52. Thus, as illustrated at reference numeral 58, the voice change assignment of channel 2 to a flute voice has been copied from the deleted section and automatically inserted into resultant MIDI file 52, at relative time 3.000.

Similarly, in order to prevent note 5 within channel 1 from "hanging" due to the removal of its matching note off message, a copy of the channel 1, note 5 off message is inserted into resultant MIDI file 52 at reference numeral 60.

In this manner, voice change assignments within a deleted or lifted section of a MIDI file are automatically propagated back into the MIDI file to ensure that this information is not lost. Similarly, the automatic insertion of note off messages into the MIDI file will assure that the removal of a note off message from the file will not result in a "hanging" note.

Thus, in the manner illustrated in FIG. 4, those skilled in the art will appreciate that the integrity of a first MIDI file, referred to herein as "source" file, may be maintained utilizing the method and apparatus of the present invention by the automatic insertion of voice change assignments or matching note off messages into the source file after the lifting or deletion of a designated section of that file.

With reference now to FIG. 5, there is depicted a textual representation of the MIDI file of FIG. 4 after reinsertion of the designated section which was removed from MIDI file 44 of FIG. 3. As above, MIDI file 62 includes a time column 64 and an event column 66. As indicated at bracket 68, the designated section of MIDI file 44 which was indicated at bracket 50 (see FIG. 3) has been inserted into resultant MIDI file 62.

In accordance with an important feature of the present invention, certain automatic modifications to this selected section of MIDI file 44 have been implemented prior to insertion to assure consistency with the results which would have been obtained by editing a digital audio stream. For example, at relative time 8.000 the voice assignments for channel 1 and channel 2 have been added to the designated section to assure that the original sound status at the beginning of that section is maintained. It should also be noted that even though the voice assignment for channel 1 at the starting point of section 68 was piano, a new voice assignment is added to section 68 to assure that this section will play as it did when it was originally lifted from its source file, regardless of whether or not subsequent voice changes have been made.

Next, in accordance with an optional feature of the present invention, the method of handling an unmatched note off message within the inserted section is illustrated. As depicted, at relative time 9.000 inserted section 68 includes a note 5 off message for channel 1. Optionally, the method and apparatus of the present invention may insert at relative time 8.000 a channel 1 note 5 on message to match the note off message contained therein. Due to the fact that the initial sound content of various notes may vary dramatically, due to the type of instrument employed, those skilled in the art will appreciate that a matching note on message may be automatically inserted into the inserted section or, alternatively, the note 5 off message may be simply ignored.

Next, in order to assure the integrity of the MIDI file which is receiving an insertion (referred to herein as the "target" file) the target file must be examined to determine whether or not any unmatched note on messages exist within MIDI file 62 at a point prior to the insertion point of selected section 68. As illustrated at relative time 5.100, at reference numeral 70, a note on message for note 6 in channel 2 is listed without a corresponding note off message prior to the insertion point of selected section 68.

Therefore, in accordance with an important feature of the present invention, a matching note off message is inserted at relative time 8.000, as indicated at reference numeral 72, which turns off note 6 within channel 2. This technique prevents note 6 from "hanging" through the insertion of section 68 within MIDI file 62.

Finally, to assure that the target file will maintain its original sound status, after the insertion of section 68, the voice assignments which existed prior to the insertion of section 68 are automatically inserted into MIDI file 62 at relative time 12.000, as indicated at reference numeral 74. By restating the previous voice assignments after the insertion of section 68, those skilled in the art will appreciate that any portion of MIDI file 62 which follows such an insertion will maintain its original sound status.

Figure 6:
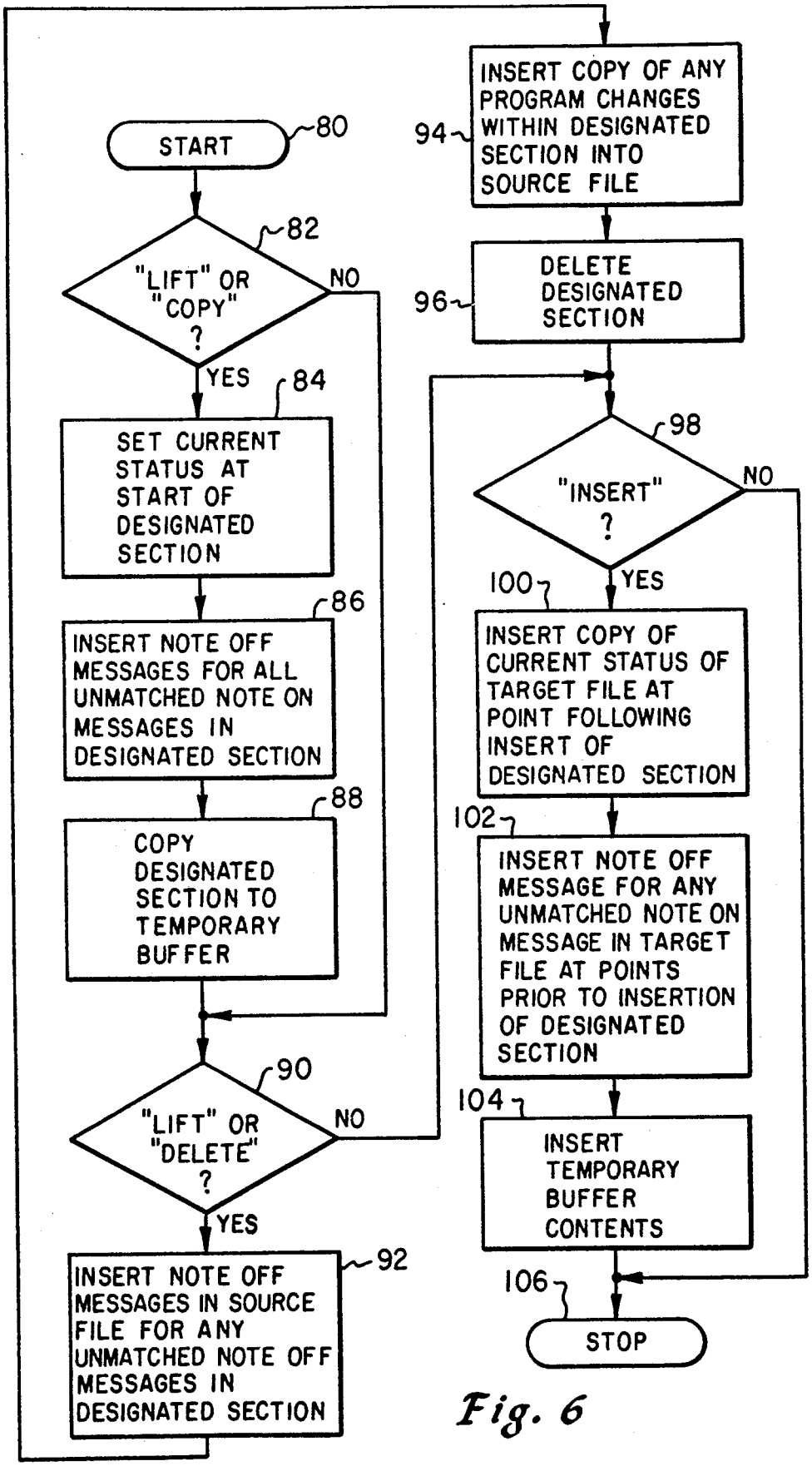
FIG. 6 is a high level flow chart illustrating the method of editing MIDI files in accordance with the present invention.

Finally, with reference to FIG. 6, there is depicted a high level flow chart which illustrates the method of editing MIDI files which has been discussed above. The process begins at block 80 and thereafter passes to block 82 which depicts a determination of whether or not the editing operation in question is a "Lift" or "Copy." If this determination indicates that the editing function is a "Lift" or "Copy" then the process passes to block 84 which depicts the setting of the current status at the start of the lifted or copied section. By setting the current status what is meant is the automatic insertion of a copy of any program change, control change, pitch blend, voice assignment or other status type information into the lifted or copied section. This is accomplished so that a lifted or copied section of a MIDI file will maintain the sound status which was in effect at the starting point of the lifted or copied section.

Next, the process passes to block 86 which illustrates the automatic provision of matching note off messages for any unmatched note on messages within the designated section to be lifted or copied. Of course, "note on" and "note off" as utilized herein are meant to include any matched pair of "on/off" commands which may be found in a MIDI data file. Examples may include "sustain on" and "sustain off" or "tremolo on" and "tremolo off." Those skilled in the art will appreciate that this is necessary to ensure that a section of a MIDI file is not lifted or copied containing a note on message without its associated note off message. Such a condition could result in the "hanging" of a note due to the absence of a corresponding note off message. Finally, the lifted or copied section of a MIDI file is then stored within a temporary buffer for future use, as depicted in block 88.

Thereafter, or in the event the editing function in question was not a "Lift" or "Copy," the process passes to block 90 which illustrates a determination of whether or not the editing function in question is a "Lift" or "Delete." If so, the process passes to block 92 which illustrates the automatic insertion of a matching note off message into the source MIDI file for any unmatched note off messages which are contained within the lifted or deleted section. This step is necessary to ensure that no "hanging" notes are left within the source file by the lifting or deletion of a designated section of the MIDI file.

Next, the process passes to block 94 which illustrates the insertion of a copy of any program changes or other events contained within the lifted or deleted section of the MIDI file to the source file. This is necessary to ensure that any section of an edited MIDI file which occurs after the lifting or deletion of a section of that file will include any necessary program information which was removed by the lifting or deletion of that file section. Block 96 then illustrates the deletion or lifting of the designated section of the MIDI file.

Finally, after a deletion of a designated section or in the event the editing function in question was not a "Lift" or "Delete," the process passes to block 98 which illustrates a determination of whether or not the editing function currently under consideration is an "Insert." If so, the process passes to block 100 which depicts the setting of the current status of the target MIDI file at a point following the insertion point. As discussed above with respect to FIG. 5, this is necessary to ensure that any changes in voice assignment or program changes which occur within a section of a MIDI file which is inserted into a target file will not affect the remainder of the original target file after the insertion point.

Next, block 102 illustrates the automatic insertion of a note off message into the target file for any unmatched note on message which exists at a point prior to the insertion point. This is necessary to ensure that a note is not turned on and left "hanging" throughout the insertion of a selected section of a MIDI file. Finally, block 104 illustrates the insertion of the content of the temporary buffer into the target MIDI file. At this point, the process terminates, as illustrated in block 106.

Upon reference to the foregoing, those skilled in the art will appreciate that the Applicants in the present application have provided a method and apparatus whereby MIDI files may be simply and graphically edited utilizing traditional "cut and paste" techniques without creating problems due to the serial nature of the messages within a MIDI file. By automatically maintaining the integrity of the source file, the lifted or copied section and the target file, the method of the present invention ensures that the original sound status within the source file, lifted or copied section, or target file is maintained and that the results of such editing will substantially duplicate the results which would have been obtained by editing digitally encoded data.

While the invention has been particularly shown and described with reference to a preferred embodiment, it will be understood by those skilled in the art that various changes in form and detail may be made therein without departing from the spirit and scope of the invention.

We claim:

1. A method for editing a MIDI file having a plurality of serially listed program status messages and matched note on and note off messages contained therein, said method comprising the steps of:

designating a section of said MIDI file having a selected starting point and a selected ending point;

automatically inserting a copy of a preceding program status message into said designated section in response to a removal or copying of said designated section of said MIDI file; and automatically inserting a matching note off message into said designated section for any unmatched note on message within said designated section in response to a removal or copying of said designated section of said MIDI file.

2. The method for editing a MIDI file according to claim 1, further including the step of automatically inserting a copy of a note off message into said MIDI file corresponding to any unmatched note off message within said designated section in response to a removal or deletion of said designated section of said MIDI file.

3. The method for editing a MIDI file according to claim 1, further including the step of automatically inserting a copy of a program status message into said MIDI file corresponding to any program status message within said designated section in response to a removal or deletion of said designated section of said MIDI file.

4. The method for editing a MIDI file according to claim 1, further including the step of automatically inserting a copy of a preceding program status message into said designated section in response to an insertion of said designated section of said MIDI file into a subsequent MIDI file.

5. The method for editing a MIDI file according to claim 1, further including the step of automatically inserting a matching note on message into said designated section for any unmatched note off message within said designated section in response to an insertion of said designated section of said MIDI file into a subsequent MIDI file.

6. The method for editing a MIDI file according to claim 1, further including the step of automatically inserting a matching note off message at said selected starting point for any unmatched note on message within a MIDI file prior to said selected starting point in response to an insertion of said designated section of said MIDI file.

7. An apparatus for editing a MIDI file having a plurality of serially listed program status messages and matched note on and note off messages contained therein, said apparatus comprising:

means for designating a section of said MIDI file having a selected starting point and a selected ending point;

means for automatically inserting a copy of a preceding status message into said designated section in response to a removal or copying of said designated section of said MIDI file; and means for automatically inserting a matching note off message into said designated section for any unmatched note on message within said designated section in response to a removal or copying of said designated section of said MIDI file.

8. The apparatus for editing a MIDI file according to claim 7, further including means for automatically inserting a copy of a note off message into said MIDI file corresponding to any unmatched note off message within said designated section in response to a removal or deletion of said designated section of said MIDI file.

9. The apparatus for editing a MIDI file according to claim 7, further including means for automatically inserting a copy of a program status message into said MIDI file corresponding to any program status message within said designated section in response to a removal or deletion of said designated section of said MIDI file.

10. The apparatus for editing a MIDI file according to claim 7, further including means for automatically inserting a copy of a preceding program status message into said designated section in response to an insertion of said designated section of said MIDI file into a subsequent file.

11. The apparatus for editing a MIDI file according to claim 7, further including means for automatically inserting a matching note on message into said designated section for any unmatched note off message within said designated section in response to an insertion of said designated section of said MIDI file into a subsequent MIDI file.

12. The apparatus for editing a MIDI file according to claim 7, further including means for automatically inserting a matching note off message at said selected starting point for any unmatched note on message within a MIDI file prior to said selected starting point in response to an insertion of said designated section of said MIDI file.

* * * * *